US006713588B2

(12) United States Patent
Fushihara

(10) Patent No.: US 6,713,588 B2
(45) Date of Patent: Mar. 30, 2004

(54) GOLF BALL

(75) Inventor: Kazuhisa Fushihara, Kobe (JP)

(73) Assignee: Sumitomo Rubber Industries Limited, Kobe (JP)

( * ) Notice: Subject to any disclaimer, the term of this patent is extended or adjusted under 35 U.S.C. 154(b) by 0 days.

(21) Appl. No.: 10/223,615

(22) Filed: Aug. 20, 2002

(65) Prior Publication Data

US 2003/0104880 A1 Jun. 5, 2003

(30) Foreign Application Priority Data

Aug. 20, 2001 (JP) ..... 2001-249483

(51) Int. Cl.[7] ..... A63B 37/12; A63B 37/14

(52) U.S. Cl. ..... 528/76; 528/80; 528/83; 528/121; 473/371; 473/378; 473/385

(58) Field of Search ..... 528/76, 80, 83, 528/121; 473/371, 378, 385

(56) References Cited

U.S. PATENT DOCUMENTS 4,679,794 A 7/1987 Yamada et al.
5,409,233 A * 4/1995 Kennedy ..... 473/377

FOREIGN PATENT DOCUMENTS

JP 8-182775 7/1996

* cited by examiner

*Primary Examiner*—David J. Buttner
(74) *Attorney, Agent, or Firm*—Birch, Stewart, Kolasch & Birch, LLP

(57) ABSTRACT

The present invention provides a golf ball having enhanced durability of the clear coating film and the mark. The golf ball of the invention comprises: a ball body having an ionomer resin cover; an epoxy coating film formed on the ball body, a polyurethane clear coating film formed on the epoxy coating film, wherein the epoxy coating film is made by curing an epoxy resin with a polyamide curing agent; and the polyurethane clear coating film is made by curing a polyol with an isocyanate curing agent, wherein the polyol is a mixture of a polyester polyol and a polyether polyol.

8 Claims, 1 Drawing Sheet

GOLF BALL

BACKGROUND OF THE INVENTION

1. Field of the Invention

The present invention relates to a golf ball where the high durability is required for the mark and the coating film like golf balls used in a golf practice shooting range, more particularly, to a golf ball which exhibits the superior adhesion of the coating film and the superior durability of the mark even if the golf ball is repeatedly subjected to shot and cleaning.

2. Description of the Related Art

A golf ball is coated with a clear coating film free of any pigment, or a coating film containing pigment. The coating film can impart the gloss to the golf ball surface, thereby improving the appearance and protecting the printed mark and number. In recent years, there is a tendency to prefer a golf ball having an ionomer resin cover finished with a clear paint, because such a golf ball is excellent in gloss and color tone. Generally, a polyurethane clear coating film is applied as the clear coating film covering the golf ball surface, because the polyurethane clear coating film has superior stretch ability and hence is easy to follow the deformation of the golf ball when it is shot.

However, the polyurethane clear coating film tends to peel off, because the adhesion between the polyurethane clear coating film and the ionomer cover is not sufficient. Further, the sunlight passes through the polyurethane clear coating film and acts directly upon the ionomer cover, thereby lowering the adhesion between the ionomer cover and the polyurethane clear coating film, when the golf ball covered with the polyurethane clear coating film is exposed to the outside.

In view of this problem, when the clear coating film is formed as a surface layer of the golf ball having the ionomer resin cover, it is proposed that a primer coat having adhesion to both the ionomer resin cover and the polyurethane clear coating film is applied between the cover and the clear coating film.

For example, Japanese Unexamined Patent Publication No. H08-182775 has proposed a primer layer which is made from the polyurethane paint. The polyurethane paint is obtained by mixing a polyol and polyisocyanate so that the amount of hydroxyl group of the polyol becomes in excess relative to the amount of isocyanate group of the polyisocyanate in molar ratio. The above polyurethane paint has superior adhesion to the ionomer cover and ensures the sufficient adhesion between the primer layer and the clear topcoat if the polyurethane clear coat with the similar composition is used.

Japanese Unexamined Patent Publication No. S61-119283 has proposed a golf ball having an ionomer resin cover onto which an epoxy clear coating film having a good adhesion thereto is formed as a primer film, and then the polyurethane clear coating film is formed on the primer film. In addition, the ultraviolet light resistance of the ionomer resin cover is improved by adding barium sulfate, a blue colorant, or a fluorescent brightener or the like thereinto.

The golf boll used in the golf practice shooting range is hit many times, used repeatedly after cleaning, and exposed to the outside much more times than the golf ball for personal use. In this case, the peel-resistance and the cleaning-resistance are highly required for the clear coating film and the mark of the golf ball. In view of this point, the conventional combination of the primer layer and the clear coating film does not meet with this requirement sufficiently, and the higher durability is required for the golf ball.

The present invention has been achieved in view of the above problems. Accordingly, it is an object of the present invention to provide a golf ball with the highly enhanced durability of the clear coating film and the mark.

SUMMARY OF THE INVENTION

The inventor of the present invention has found that: an epoxy coating film prepared by curing an epoxy resin with a polyamide curing agent has superior compatibility with and adhesion to both of the ionomer resin cover and the polyurethane clear coating film; and the use of a specific polyol imparts a superior durability against the deformation when hit and against alkali cleaning to the polyurethane clear coating film, and has achieved the present invention.

According to the present invention, there is provided a golf ball comprising: a ball body having an ionomer resin cover; an epoxy coating film formed on the ball body, and a polyurethane clear coating film formed on the epoxy coating film, wherein the epoxy coating film is made by curing an epoxy resin with a polyamide curing agent; and the polyurethane clear coating film is made by curing a polyol with an isocyanate curing agent, wherein the polyol is a mixture of a polyester polyol and a polyether polyol.

The foregoing and other objects, features and attendant advantages of the present invention will become apparent from the reading of the following detailed description in conjunction with the accompanying drawing.

DETAILED DESCRIPTION OF THE PREFERRED EMBODIMENTS

Figure 1:
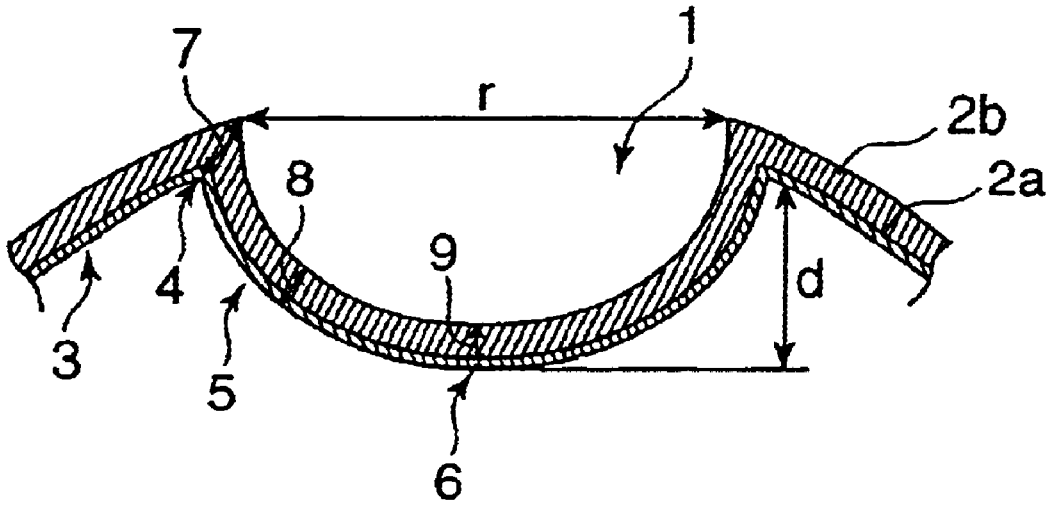
FIG. 1 is an enlarged schematic view of a portion around a dimple on the surface of the coated golf ball.

The golf ball of the present invention has an epoxy coating film on the surface of a golf ball body comprising a core covered with an ionomer resin cover and a polyurethane clear coating film formed on the epoxy coating film. The epoxy coating film is made by curing an epoxy resin with a polyamide curing agent and the polyurethane clear coating film is made by curing a specific polyol with an isocyanate.

The core, which constitutes a part of the golf ball body, without limitation, includes a wound core, single layered core, or a multi-layered core. The core can be made from vulcanized rubber or any other core stock without any particular limitation.

The ionomer resin cover is the cover made from a cover stock material which comprises an ionomer resin as a chief component. The cover stock material may further include a thermoplastic elastomer and the like in addition to the ionomer resin. The ionomer resin cover can be formed of a single-layered structure or a multi-layered structure having at least two layers.

The ionomer resin may be one prepared by neutralizing at least a part of carboxyl groups in a copolymer of ethylene and α,β-unsaturated carboxylic acid with metal ion or one prepared by neutralizing at least a part of carboxyl groups in a terpolymer of ethylene, α,β-unsaturated carboxylic acid and α,β-unsaturated carboxylic acid ester with metal ion. Examples of the α,β-unsaturated carboxylic acids are acrylic acid, methacrylic acid, fumaric acid, maleic acid, and crotonic acid. Among them, acrylic acid and methacrylic acid are particularly preferable. Examples of the α,β-unsaturated carboxylic acid esters are methyl ester, ethyl ester, propyl ester, n-butyl ester, isobutyl ester and the like of acrylic acid, methacrylic acid, fumaric acid, maleic acid and the like. Among them, acrylic acid ester and methacrylic acid ester are particularly preferable. Metal ions for neutralization include sodium ion, potassium ion, lithium ion, magnesium ion, calcium ion, zinc ion, barium ion, aluminum ion, tin ion, zirconium ion, and cadmium ion.

The thermoplastic elastomer is a block copolymer in which a polymer block forming a hard segment is bonded to a polymer block forming a soft segment. Examples of the thermoplastic elastomers are a polyester-type thermoplastic elastomer of which the hard segment is polyester, a polyurethane-type thermoplastic elastomer of which the hard segment is polyurethane bond, an amide-type thermoplastic elastomer of which the hard segment is polyamide, a polystyrene-type elastomer of which the hard segment is polystyrene, and a polyolefin-type elastomer of which the hard segment is polyethylene or polypropylene.

As required, the cover stock material for the ionomer resin cover may further include additives, e.g., a white pigment such as titanium dioxide or a blue colorant, and a dispersant, an antioxidant, an ultraviolet absorber, a light stabilizer and the like, in addition to the ionomer resin as the predominant component and other polymer components.

The ionomer resin cover has, without particular limitation, the thickness of about 0.3 to about 3.5 mm. The cover is preferably formed with a multiplicity of depressions called dimples on the surface.

An epoxy coating film is formed on, preferably all over, the surface of the ionomer resin cover having the feature described above. The epoxy coating film is formed by curing an epoxy resin with a polyamide curing agent. The epoxy coating film has superior compatibility with both of the ionomer resin cover and the polyurethane clear coating film, and hence the intervention of the epoxy coating film between the two improves the adhesion of the polyurethane clear coating film to the ionomer resin cover.

Any epoxy resin having an epoxy ring may be used for the epoxy coating film. Examples of the epoxy resin are a bisphenol A type epoxy resin prepared by reacting bisphenol A with an epoxy group-containing compound such as epichlorhydrin, a bisphenol F type epoxy resin prepared by reacting bisphenol F with an epoxy group-containing compound, and a bisphenol AD type epoxy resin prepared by reacting bisphenol AD with an epoxy group-containing compound such as epichlorhydrin. Among them, the bisphenol A type epoxy resin is preferably used in view of its well-balanced flexibility, chemical resistance, heat resistance and toughness.

The polyamide curing agent is a curing agent having a plurality of amino groups capable of reacting with epoxide and at least one amide group in a molecule thereof. Examples of the polyamide curing agents are a high-molecular-weight curing agent such as a polyaminoamide resin obtained by the condensation reaction between a polymerized fatty acid and a polyamine, and a polyaminoamide and a polyoxyalkylenepolyamide synthesized from polyethylenepolyamine; and a low-molecular-weight curing agent functioning like the high-molecular-weight curing agents mentioned above.

The polymerized fatty acid for use in the preparation of the polyamide curing agent may be synthesized by heating a natural fatty acid, such as tall oil, soybean oil, linseed oil or fish oil, which is rich in an unsaturated fatty acid such as linoleic acid or linolenic acid, in the presence of a catalyst. The polymerized fatty acid preferably has a dimer portion in a proportion of not less than 90% by mass and a trimer portion in a proportion of not more than 10% by mass and is preferably hydrogenated. The polyamine for use in the preparation of the polyamide curing agent may be any polyamine which can be used in the preparation of a polyamide resin. Examples of the polyamines are ethylenediamine, diethylenetriamine, and triethylenetetramine.

In the preparation of the epoxy coating film according to the present invention, the mixing ratio of the amount of the epoxy resin to the amount of the polyamide curing agent preferably ranges between 1/1 and 1/1.4 in terms of epoxy equivalent weight/amine's active hydrogen equivalent weight.

Epoxy coating film is generally poor in weather resistance and tends to change in color due to the irradiation of the ultraviolet light or the like. The epoxy coating film that is used as a primer coat in the invented golf ball is combined with the clear coat film serving as the topcoat constituting the surface layer of the golf ball. For this reason, the weather resistance of the epoxy coating film is critical also from the viewpoint of the adhesion of the epoxy coating film to the ionomer resin cover. It is therefore preferred that the epoxy coating film contains a pigment. In the case of a white golf ball, a white pigment may also be used for the epoxy coating film. Examples of the white pigments are titanium oxide, barium sulfate, and calcium carbonate. Among them, titanium oxide is preferably used. In addition, the epoxy coating film may further contain a leveling agent, viscosity modifier, fluorescent brightener, anti-blocking agent, or the like, if necessary.

The epoxy coating film preferably has the thickness of 1 to 20 μm, more preferably 2 to 10 μm. If the epoxy coating film is too thin, the coating film is easy to peel off, while if it is too thick, the dimple size becomes smaller, which may result in a shorter flight distance.

The golf ball of the present invention further comprises the polyurethane clear coating film formed on the above epoxy coating film. The polyurethane clear coating film is preferably formed all over the epoxy coating film. The polyurethane clear coating film is made by curing a polyol comprising a mixture of a polyester polyol and a polyether polyol with an isocyanate curing agent.

The polyurethane clear coating film exhibits the excellent wear-resistance to the stimuli from the external, and also exhibits so superior adhesion as to follow the deformation of the golf ball sufficiently when it is hit. Further, the polyurethane clear coating film exhibits superior adhesion to the ionomer resin cover as well as high durability against alkali cleaning through the intervening epoxy primer coating film.

As the polyester polyol increases in the proportion of the polyol used as a constituting component of the polyurethane clear coating film, the coating film becomes harder, and hence becomes more improved in wear-resistance to the stimuli from the external such as rubbing with a club face upon shots, rubbing with a brush during cleaning, and rubbing with other balls. However, if the coating film becomes too hard, the coating film does not follow the deformation of the golf ball, resulting in the lower adhesion, the crack or the peel in the worse case, of the coating film.

On the other hand, as the polyether polyol increases in the proportion of the polyol, the coating film becomes softer and easier to follow the deformation of the golf ball when it is hit, thereby improving the adhesion. However, if the proportion of the polyether polyol is too high, the coating film becomes so soft that the wear-resistance to the stimuli from the external is lowered. Therefore, in order to impart the well-balanced adhesion and wear resistance to the polyurethane clear coating film, the mixing ratio (molar ratio) of the polyether polyol to the polyester polyol is adjusted to 60/40 or higher, preferably 70/30 or higher in terms of the (mole) ratio of the number of ether groups contained in the polyol to the number of ester groups contained in the polyol. The upper limit of the ratio is 95/5, preferably 90/10. Examples of the polyether polyol are polyoxyethylene glycol (PEG), polyoxypropylene glycol (PPG), and polyoxytetramethylene glycol (PTMG). Examples of the polyester polyol are polyethylene adipate (PEA), polybutylene adipate (PBA), and polyhexamethylene adipate (PHMA).

The isocyanate curing agent for curing the polyol includes any isocyanate curing agent conventionally used in polyurethane paint, as long as it has at least two isocyanate groups. Examples of the isocyanate curing agents are, but are not limited to, aromatic diisocyanate compounds such as tolylene diisocyanate, diphenylmethane diisocyanate, polymethylenepolyphenyl polyisocyanate, tolidine diisocyanate, naphthalene diisocyanate; aliphatic or alicyclic diisocyanate compounds such as hexamethylene diisocyanate (HDI), xylylene diisocyanate (XDI), hydrogenated xylylene diisocyanate ($H_6$XDI), isophorone diisocyanate (IPDI), tetramethylxylylene diisocyanate (TMXDI), and hydrogenated diphenylmethane diisocyanate ($H_{12}$MDI). These compounds may be used either alone or as a mixture of at least two of them. Among them, non-yellowing isocyanates (aliphatic or alicyclic isocyanates) are preferable.

The isocyanate curing agent may be mixed into the polyol shortly before use. The mixing ratio between the two is preferably not less than 0.9, more preferably not less than 1.1 based on the ratio of the isocyanate group of the polyisocyanate to the hydroxyl group of the polyol (isocyanate group/hydroxyl group). The upper limit of the ratio is preferably 1.5, more preferably 1.3.

As required, the polyurethane clear coating film may further contain a silicone slip agent, leveling agent, viscosity modifier, fluorescent brightener, anti-blocking agent or the like.

The polyurethane clear coating film preferably has the mean thickness of not less than 6 $\mu$m, more preferably not less than 8 $\mu$m. The upper limit of the mean thickness of the polyurethane clear coat is preferably 16 $\mu$m, more preferably 14 $\mu$m.

FIG. 1 shows the cross sectional view of the golf ball of the present invention. As shown in FIG. 1, a multiplicity of dimples are formed onto the surface of the golf ball body. The epoxy coating film 2*a* is formed on dimple 1, then the polyurethane clear coating film 2*b* is formed on the epoxy coating film. In this case, the polyurethane clear coating film has the different thickness at the hill-slope portion 3, edge portion 4, hollow slope portion 5 and bottom portion 6, respectively, due to the coating condition.

The polyurethane clear coating film 2*b* preferably has the thickness of at least 6 $\mu$m, more preferably 7 $\mu$m or more, most preferably 9 $\mu$m or more at the hill-slope portion 3, while the upper limit of the thickness is preferably 15 $\mu$m, more preferably 12 $\mu$m. At the edge portion 4, the polyurethane clear coating film 2*b* preferably has the thickness of at least 6 $\mu$m, more preferably 7 $\mu$m or more, while the upper limit of the thickness is preferably 12 $\mu$m, more preferably 10 $\mu$m.

If the thickness of the polyurethane clear coating film is less than the lower limit described above, the wear-resistance of the coating film is lowered and the coating film tends to peel off when subjected to alkali cleaning. If the polyurethane clear coating film becomes too thick, the dimple size (corresponding to the size indicated by r in FIG. 1) is relatively reduced, resulting in a shorter flight distance. It is highly important that the polyurethane clear coating film has the thickness which falls within the above range at the hill-slope portion 3 and at the edge portion 4 from the view point of the wear resistance. Because the polyurethane clear coating film is frequently subjected to the wearing at the hill-slope portion 3 and the edge portion 4. In addition, it is also effective especially for the case that the mark is printed on the epoxy coating film and covered with the polyurethane clear coating film as described later. The polyurethane clear coating film is configured as above, and may be formed of a single layer or of at least two layers such as a combination of a polyurethane primer layer and a polyurethane topcoat layer.

In the case that the mark is printed on the golf ball of the present invention, it is preferred that the mark is printed on the epoxy coating film and covered with the polyurethane clear coating film. If the mark intervenes between the polyurethane clear coating film and the epoxy coating film, the durability of the mark can be ensured due to the good adhesion between the polyurethane clear coating film and the epoxy resin coating film. The epoxy coating film may further contain a pigment in view of the weather-resistance.

Damage to the mark occurs when the polyurethane clear coating film peels off and the mark is easily exposed to the wear, when the mark peels off from the epoxy coating film, or when the mark peels off together with the polyurethane clear coating film. The polyurethane clear coating film tends to peel off at the hill-slope portion 3 and the edge portion 4 of the dimple which form the contacting-surface to the external. In addition, it is difficult to coat the paint well at the edge portion 4. Therefore, the durability of the mark against the peeling can be considerably improved by inhibiting the polyurethane coating film itself from peeling off, if the polyurethane clear coating film at the edge portion 4 is made to have a thickness of 6 $\mu$m or more within the aforementioned range.

Generally, it is difficult to coat the paint thick at the edge portion. However, the polyurethane clear coating film can be made sufficiently thick at the edge portion by coating the polyurethane clear coating film over the epoxy coating film having the superior adhesion to the polyurethane clear coating film.

The epoxy coating film is formed on the surface of the golf ball body and then the polyurethane clear coating film is formed on the epoxy coating film. The epoxy coating film and the polyurethane clear coating film are formed by coating the surface of the ball body with a two-part curing type paint according to an well known coating process such as spray coating, brushing or painting gun coating, followed by curing. Examples of the two-part curing type paint is a combination of an epoxy resin and a polyamide-type curing agent and a combination of a polyol and an isocyanate-type curing agent.

The ball body is preferably subjected to a surface-roughening treatment known to those skilled in the art such as sandblasting, shot blasting or buffing prior to coating the paint. The surface-roughening treatment makes it possible to improve the adhesion between the ball body surface (ionomer resin cover) and the epoxy coating film physically.

There is no particular limitation on the ink used for printing the mark, and any one of inks conventionally used for printing the mark may be used. Specifically, an ink containing a nitrocellulose resin, polyester resin, epoxy resin or the like as a carrier of a pigment is preferable. Further, typically preferred is an ink using an isocyanate as a curing agent.

As required, the ink may further contain additives such as a flatting agent or a solvent in addition to the coloring agent, the resin used as the carrier and the curing agent.

Any mark-printing process such as a pad printing process using a pad and a transfer printing process using a transfer foil, may be employed without any particular limitation.

EXAMPLES

The following examples illustrate the present invention, however these examples are intended to illustrate the invention and are not to be construed to limit the scope of the invention. Many variations and modifications of such examples will exist without departing from the scope of the inventions. Such variations and modifications are intended to be within the scope of the invention.

Evaluation Methods (1) Adhesion

Golf balls left under natural light for one month were each hit 100 times, and then the coating film of each ball was incised into squares to examine the proportion of the peeled squares. In the evaluation, the peeled squares include the squares where only the topcoat (the second layer) which forms the surface layer of the golf ball peeled off, in addition to the squares where the primer coat (the first layer) which is formed directly on the ball body surface also peeled off together with the topcoat.

Evaluation was made according to the following rating criteria:

"Poor": The coating film peeled off in the proportion of 10% or more.

"Fair": The coating film peeled off in the proportion of not less than 1% and less than 10%; and "Good": The coating film peeled off in the proportion of less than 1%.

(2) Wear Resistance

Twelve golf balls were prepared for each type of the golf ball. Each of the twelve golf balls was actually hit 150 times. Thereafter, the peeled area of the coating film and the mark of each golf ball were measured. Each golf ball was evaluated by the following five criteria, according to the proportion of the peeled area with respect to the total surface area of the golf ball. The averaged values of twelve golf balls were regarded as the result of the wear resistance of the each type of the golf ball.

Criteria

0: no peel

1: The proportion of the peeled area is not more than 20%.

2: The proportion of the peeled area is more than 20% to not more than 40%.

3: The proportion of the peeled area is more than 40% to not more than 60.

4: The proportion of the peeled area is more than 60% to not more than 80.

5: The proportion of the peeled area is more than 80%.

(3) Weather Resistance

A weather resistance test (JIS-D0205) was conducted using "SUNSHINE SUPERLONGLIFE WEATHEROMETER (WEL-SUN-HC/B Model)" available from SUGA SHIKENKI CO. under the conditions: irradiation=120 hours, chamber temperature=63° C., humidity=50%, and 12 minutes' rainfall per 60 minutes.

The color tone of each golf ball was measured before and after the irradiation to determine the degree of color change. Specifically, a measuring point was fixed on each golf ball, and the "L", "a" and "b" values of the color tone at the measuring point were measured before and after the irradiation with use of a color difference meter. Using the "L", "a" and "b" values thus measured, ΔE was obtained based on the following formula.

$$\Delta E=[(\Delta L)^2+(\Delta a)^2+(\Delta b)^2]^{1/2}$$

The "L", "a" and "b" values of the chromaticity of each golf ball were measured after coating and after ultraviolet irradiation with a color difference meter (CR-221 manufactured by Minolta Co., Ltd.). The differences between the "L", "a" and "b" values measured after coating and those measured after ultraviolet irradiation (ΔL, Δa and Δb) were substituted into the above formula to obtain the value of ΔE. The ΔE of each golf ball was reduced to an index relative to the ΔE of golf ball No. 2 regarded as 100. A larger index is indicative of a higher degree of color change.

(4) Alkali Resistance

Each golf ball was immersed into a four-fold dilution of the cleaning agent for 50 minutes and then washed with water. The cleaning agent was commercially available under the name of "YOGORETOL" (pH=13.7 to 14.0) from YOKOHAMA YUSHI KOGYO CO., LTD, which was used in the golf practice shooting range. The peeled conditions of the coating film and the mark were evaluated according to the foregoing evaluation method for wear resistance.

(5) Thickness of Coating Film

Three dimples of each golf ball were selected, and thicknesses of the coating film layer at the hill-slope portion, the edge portion, the hollow slope portion and the bottom portion of each dimple were measured to obtain the average thickness of the coating film.

The thickness of the coating film was measured by observing a cut surface of a dimple portion using a microscope. Measurement was performed in a direction along a perpendicular line extending through the golf ball body to the plane tangential to a measuring point on the surface of the coating film; for example, directions indicated at 7, 8 and 9 in FIG. 1. Though the portions 7 to be measured are each shown to form an acute angle in the schematic view of FIG. 1, such portions of an actual golf ball are somewhat rounded. In such a case, measurement is also performed in a direction along a perpendicular line to the plane tangential to a measuring point on such a somewhat rounded portion.

(6) Flight Distance

Each golf ball was hit with a driver attached to a swing robot manufactured by TRUETEMPER CO. at the head speed of 40 m/sec, and the flight distance (carry) from the hitting point to a point at which the ball dropped to the ground was measured. The carry thus measured was reduced to an index relative to the carry of golf ball No. 6 regarded as 100. The golf ball No. 6 has a polyurethane primer coat which falls within the prior art.

Twelve golf balls of each ball type were measured as to their respective carries to find an average value. A larger index is indicative of a longer carry.

Manufacture of Golf Ball

A core composition shown in Table 1 was prepared, homogeneously kneaded, put into a mold and press-molded at 144° C. for 20 minutes to form a core having a diameter of 38.5 mm. Subsequently, a cover composition shown in Table 1 was injection-molded onto the core to form a golf ball body having a diameter of 42.7 mm.

The surface of the golf ball body thus obtained was ground to remove the releasing agent which had adhered to the surface during the press-molding. Thereafter, the golf ball body was coated with a primer paint (an epoxy paint or a polyurethane paint) shown in Table 2 and then dried at 40° C. for 24 hours to form a primer coating film (the first layer). A mark was printed on this primer coating film by a pad printing process using the ink shown in Table 1, and then the golf ball body was coated with a polyurethane paint having a polyol component shown in Table 2 as a topcoat paint. The golf ball body thus coated with the polyurethane paint was allowed to stand at 40° C. for 18 hours to cure the polyurethane paint, thereby forming a polyurethane clear coating film (the second layer).

TABLE 1

| | Amount(Parts by mass) |
|---|---|
| Core | |
| Butadiene rubber | 100 |
| Zinc oxide | 3 |
| Zinc acrylate | 25 |
| Barium sulfate | 17.7 |
| Dicumyl peroxide | 1.65 |
| Cover | |
| Himilan 1557 | 30 |
| Himilan 1707 | 20 |
| Himilan 1855 | 50 |
| Titanium oxide | 2 |
| Ink | |
| Nitrocellulose resin | 16.8 |
| Polyester resin | 4.2 |
| Phtalocyanine blue | 9.0 |
| Hexamethylenediisocyanate | 7.0 |

TABLE 1-continued

| | Amount(Parts by mass) |
|---|---|
| Flatting agent | 14.0 |
| Solvent (aromatic hydrocarbon + methocymethylbutylacetate) | 49.0 |

The epoxy paint which comprising a bisphenol A type epoxy resin with a polyamide curing agent (epoxy equivalent weight/amine's active hydrogen equivalent weight=1.1) was used as the primer paint The epoxy paint was mixed with or not mixed with a white pigment (titanium oxide). As the polyurethane primer paint, a polyester polyol was used as a polyol, and hexamethylene diisocyanate was used as an isocyanate-type curing agent. Any white pigment was not added to the polyurethane primer paint.

A two-part curing type polyurethane clear paint comprising a polyol and an isocyanate-type curing agent (hexamethylene diisocyanate) was used as the topcoat paint. The polyol and the isocyanate-type curing agent were mixed so that the molar ratio of isocyanate group/hydroxyl group became 1.1. The polyol, a mixture of polyester polyol and polyether polyol, shown in Table 2 was used for the topcoat polyurethane clear paint. The mixing ratio of a polyester polyol and a polyether was also represented by the molar ratio of the number of ether groups/the number of ester groups in Table 2.

The thickness of the polyurethane clear coating film formed by coating the polyurethane clear paint, at the hill-slope portion, edge portion, hollow slope portion and bottom portion of a dimple were also shown in Table 2, respectively.

Coated golf balls Nos. 1 to 10 thus manufactured were each evaluated in terms of adhesion, wear resistance, alkali resistance, weather resistance of the mark and coating film, according to the evaluation methods described above. The results of the evaluation were also shown in Table 2.

TABLE 2

| Golf ball No. | 1 | 2 | 3 | 4 | 5 | 6 | 7 | 8 | 9 | 10 |
|---|---|---|---|---|---|---|---|---|---|---|
| First layer | | | | | | | | | | |
| Type | Epoxy | Epoxy | Epoxy | Epoxy | Epoxy | PU | Epoxy | Epoxy | Epoxy | Epoxy |
| White pigment | − | + | − | + | + | − | + | − | + | + |
| Second layer | | | | | | | | | | |
| Type | PU | PU | PU | PU | PU | PU | PU | PU | PU | PU |
| Polyether/Polyester | 90/10 | 90/10 | 100/0 | 100/0 | 0/100 | 90/10 | 90/10 | 90/10 | 90/10 | 90/10 |
| Thickness(μm) | | | | | | | | | | |
| Hill-slope portion | 11 | 11 | 12 | 12 | 10 | 10 | 9 | 3 | 4 | 17 |
| Edge portion | 8 | 7 | 8 | 9 | 8 | 8 | 5 | 2 | 3 | 13 |
| Hollow-slope portion | 10 | 11 | 11 | 11 | 10 | 10 | 6 | 3 | 4 | 22 |
| Bottom portion | 12 | 12 | 12 | 13 | 12 | 11 | 11 | 5 | 5 | 20 |
| Average thickness | 10.3 | 10.3 | 10.8 | 11.3 | 10.0 | 9.8 | 7.8 | 3.3 | 4.0 | 18.0 |
| Evaluation | | | | | | | | | | |
| Flight distance | — | — | — | — | — | 100 | 101 | 101 | 101 | 98 |
| Adhesion | Good | Good | Fair | Fair | Poor | Good | Good | Good | Good | Good |
| Wear resistance | | | | | | | | | | |
| Mark | 1.2 | 1.2 | 2.4 | 2.3 | 1.4 | 1.6 | 2 | 3.7 | 3.3 | 1.1 |
| Coating film | 2 | 2.1 | 4.1 | 4.2 | 2.2 | 2.8 | 2.9 | 3.5 | 3.6 | 1.9 |

TABLE 2-continued

| Golf ball No. | 1 | 2 | 3 | 4 | 5 | 6 | 7 | 8 | 9 | 10 |
|---|---|---|---|---|---|---|---|---|---|---|
| Alkali resistance | | | | | | | | | | |
| Mark | 1.2 | 1.1 | 1.3 | 1.2 | 1.4 | 3.4 | 1.2 | 1.2 | 1.1 | 1.3 |
| Coating film | 1.5 | 1.5 | 1.9 | 1.6 | 1.7 | 4.1 | 1.6 | 1.8 | 1.7 | 2.0 |
| Weather resistance(ΔE) | 125 | 100 | — | — | — | — | — | 129 | 104 | — |

Epoxy: Epoxy clear coating film
PU: Polyurethane clear coating film
"+": White pigment is used,
"–": White pigment is not used The comparison between the golf balls No. 1 and No. 6 indicated that the golf ball No. 6 having a polyurethane primer coat was inferior to golf ball No. 1 in alkali resistance of the mark and the coating film, though their respective polyurethane topcoats were of the same composition and had substantially equal thickness. As can be understood from this result, it is necessary for the epoxy coating film to intervene between an ionomer cover and a polyurethane clear coating film so that the mark and the coating film can exhibit adhesion sufficient to resist alkali cleaning. Further, the golf ball No. 6 was slightly inferior to the golf ball No. 1 in terms of the wear resistance of the mark and coating film, although the polyurethane topcoat of golf ball No. 6 had the same composition as that of the golf ball No. 1. According to this result, it can be deduced that the wear resistance of the mark and the coating film is dependent on not only the composition of the polyurethane topcoat, but also the adhesion to the cover.

Although golf balls Nos. 1 to 5 are common in the point of using an epoxy coating film as a primer coat, golf balls Nos. 3 to 5 were inferior to golf balls Nos. 1 and 2 in the adhesion of their coating films when they were hit, and tended to exhibit inferior alkali resistance. Because golf balls Nos. 3 to 5 did not employ a mixture of a polyester polyol and a polyether polyol as a polyol component for their polyurethane clear coating films, while golf balls Nos. 1 and 2 employed such a mixture. As can be understood from this result, the combination of the epoxy coating film as a primer coat and the polyurethane clear coating film as a topcoat can exhibit more improved adhesion if the polyurethane clear coating film comprises a mixture of a polyester polyol and a polyether polyol as the polyol component. Since the golf ball No. 5 was particularly inferior in adhesion, it is preferable that the polyol component should contain a polyether polyol. Further, the golf balls Nos. 3 and 4 were particularly inferior in wear resistance, thus it is preferable that the polyol component should contain a polyester polyol. These results indicated that blending of the polyester polyol is preferable in order to make the polyurethane coating film harder and more wear-resistant; and blending of a polyether polyol is preferable in order to impart such stretchability to the polyurethane coating film as to allow it to follow the deformations of the golf ball that will occur upon shots. The comparison between golf balls Nos. 1 and 2 indicated that the epoxy coating film preferably contains a pigment from the viewpoint of weather-resistance.

Golf balls Nos. 7 to 10 each comprised a combination of the epoxy coating film as a primer coat and the polyurethane clear coating film having a mixture of a polyester polyol and a polyether polyol as the polyol component. Among them, the golf ball No. 10 had a thick polyurethane clear coating film, while golf balls Nos. 7 to 9 each had a thin polyurethane clear coating film. The flight distance was slightly short in the case of the thick polyurethane clear coating film. This is because the improving effect of the flying performance by the dimples was not sufficiently obtained. If the topcoat is so thin as in golf balls Nos. 8 and 9, the wear resistance of the coating film and the mark tends to be lowered because the topcoat wears out rapidly. As apparent from the result of the golf ball No. 7, in the case of a topcoat having a mean thickness of 6 μm or more but having a thickness of less than 6 μm at the edge portion, the wear resistance of the mark and the coating film tends to be lowered. Thus, the thickness of the topcoat at the edge portion is important in view of the wear resistance.

Among the golf balls Nos. 1, 2, and 7 to 10, there was not found any difference in alkali resistance dependent on the thickness of the polyurethane clear coating film. It is considered that the alkali resistance is greatly dependent on the composition of the primer coating film used and on the polyol component of the polyurethane coating film used. It is difficult to improve the alkali resistance even if the thickness of the topcoat is varied.

The golf ball of the present invention uses a specific polyol component for the polyurethane clear coating film which forms the surface layer of the coated golf ball, and hence, the coating film has the superior wear-resistance against the external stimuli and exhibits the superior adhesion to follow the deformations of the golf ball when it is hit. Further, the golf ball of the present invention has the specific epoxy coating film intervening between the clear coating film and the ionomer resin cover and having the superior adhesion to both of the two. For this reason, the coating film of the golf ball exhibits the superior adhesion even when the golf ball is subjected to alkali cleaning. Thus, the golf ball of the present invention is suitable for use in golf practice shooting range where the golf balls are subject to repeated hitting and alkali cleaning. Since the mark is printed on the epoxy coating film and covered with the polyurethane clear coating film, the durability of the mark becomes excellent.

This application is based on Japanese Patent application No. 2001-249483 filed on Aug. 20, 2001, the contents of which are hereby incorporated by reference.

What is claimed is:

1. A golf ball comprising:

a ball body having an ionomer resin cover;

an epoxy coating film formed on the ball body; and a polyurethane clear coating film formed on the epoxy coating film, wherein the epoxy coating film is made by curing an epoxy resin with a polyamide curing agent, and the polyurethane clear coating film is made by curing a polyol with an isocyanate curing agent, wherein the polyol is a mixture of a polyester polyol and a polyether polyol.

2. The golf ball according to claim 1, wherein the polyol has a mixing ratio of 60/40 to 95/5 based on the mole ratio of the ether group of the polyether polyol to the ester group of the polyester polyol.

3. The golf ball according to claim 1, wherein the epoxy coating film contains a white pigment.

4. The golf ball according to claim 1, wherein the polyurethane clear coating film has an average thickness of 6 to 16 $\mu$m.

5. The golf ball according to claim 4, wherein the ball body has a surface formed with a plurality of dimples each having an edge portion and the polyurethane clear coating film has a thickness of 6 to 12 $\mu$m at the edge portion.

6. The golf ball according claim 1, wherein a mark is printed on the epoxy coating film and then covered with the polyurethane clear coating film.

7. The golf ball according to claim 1, wherein the polyamide curing agent is polyaminoamide.

8. The golf ball according to claim 1, wherein the ratio of the amount of the epoxy resin to the amount of the polyamide curing agent ranges from 1/1 to 1/1.4 in terms of epoxy equivalent weight/amine's active hydrogen equivalent weight.

* * * * *